US010475289B2

(12) United States Patent
Birkenmeyer

(10) Patent No.: US 10,475,289 B2
(45) Date of Patent: Nov. 12, 2019

(54) METHOD, SYSTEM, AND DEVICE FOR CONDUCTING A SIDE BET FOR A POKER GAME

(71) Applicant: Innovative Gaming Concepts, LLC, Boynton Beach, FL (US)

(72) Inventor: Brian Patrick Birkenmeyer, Boynton Beach, FL (US)

(73) Assignee: Innovative Gaming Concepts LLC, Lake Worth, FL (US)

( * ) Notice: Subject to any disclaimer, the term of this patent is extended or adjusted under 35 U.S.C. 154(b) by 76 days.

(21) Appl. No.: 15/874,598

(22) Filed: Jan. 18, 2018

(65) Prior Publication Data

US 2018/0204418 A1 Jul. 19, 2018

Related U.S. Application Data

(60) Provisional application No. 62/447,899, filed on Jan. 18, 2017.

(51) Int. Cl.
*G07F 17/32* (2006.01)

(52) U.S. Cl.
CPC ..... *G07F 17/3288* (2013.01); *G07F 17/323* (2013.01); *G07F 17/3218* (2013.01); *G07F 17/3223* (2013.01); *G07F 17/3248* (2013.01); *G07F 17/3258* (2013.01); *G07F 17/3276* (2013.01); *G07F 17/3293* (2013.01)

(58) Field of Classification Search
USPC ..... 463/13
See application file for complete search history.

(56) References Cited

U.S. PATENT DOCUMENTS

2006/0046822 A1* 3/2006 Kaminkow ..... G07F 17/32 463/16
2010/0120499 A1* 5/2010 Cohen ..... G07F 17/3244 463/20
2012/0309514 A1* 12/2012 Kaminkow ..... G07F 17/32 463/30
2015/0080117 A1* 3/2015 Czyzewski ..... G07F 17/34 463/27
2017/0169665 A1* 6/2017 St. John ..... G07F 17/3267
2018/0268656 A1* 9/2018 Czyzewski ..... G07F 17/34

* cited by examiner

*Primary Examiner* — Pierre E Elisca
(74) *Attorney, Agent, or Firm* — Mark C. Johnson; Johnson | Dalal

(57) ABSTRACT

A method of providing a house-banked side game that includes receiving a side bet in the side game associated with the base game from one or more players in the base game, the side bet corresponding to a side game having a payout triggering event associated with a group of community playing cards being the same as at least one preset combination of playing cards, dealing at least two of the playing cards to at least two of users participating in the base game, dealing at least three community playing cards to the group of community playing cards shared by a at least two users participating in the base game, comparing the first three community playing cards with the preset combination, awarding a payout to the players from which a side bet is received responsive to the payout triggering event, and maintaining the side bets thereafter.

6 Claims, No Drawings

METHOD, SYSTEM, AND DEVICE FOR CONDUCTING A SIDE BET FOR A POKER GAME

CROSS-REFERENCE TO RELATED APPLICATION

This application claims priority to U.S. Provisional Patent Application No. 62/447,899 filed Jan. 18, 2017, the entirety of which is incorporated by reference.

FIELD OF THE INVENTION

The present invention relates generally to method and system of conducting a wager for a poker game and, more particularly, relates to a specialized and organized unconventional method of wagering in a poker game.

BACKGROUND AND SUMMARY OF THE INVENTION

The invention provides a method, system, and device for conducting a side bet for a poker game that overcomes the hereinafore-mentioned disadvantages of the heretofore-known devices and methods of this general type.

With the foregoing and other objects in view, there is provided, in accordance with the invention, a method of providing a house-banked side game associated with a player-banked poker game, the method that includes the steps of providing at least one deck of playing cards, the at least one deck of playing cards having four suits with each of the four suits associated therewith of a varying rank, the at least one deck of playing cards utilized in a base game in which a group of community playing cards is dealt to enable players to form a final hand in the base game, but the base game may be resolved prior to group of community playing cards being formed. The method also includes receiving a side bet in the side game associated with the base game from one or more players in the base game, wherein the side bet corresponds to a side game having a payout triggering event associated with the group of community playing cards being the same as at least one preset combination of playing cards. Additionally, the method may include dealing at least two of the playing cards to at least two of users participating in the base game, dealing at least three community playing cards to the group of community playing cards shared by the at least two users participating in the base game, comparing the first three community playing cards with the preset combination, awarding a payout to the players from which a side bet is received responsive to the payout triggering event being triggered by the comparison step, maintaining the side bets received in a pot to be made available for the next side game responsive to less than three community playing cards being dealt to the group of community playing cards.

In accordance with another feature, an embodiment of the present invention includes a step of assigning a portion of the side bets received to a progressive jackpot and/or collecting the remainder as a loss responsive to the payout triggering event not being triggered.

In accordance with a further feature of the present invention, the base game may be a game of skill, such as Texas Hold'em Poker, whereas the side game is a game of chance. The base game may also be a player-banked poker game and the side game may be a house-banked poker game. The base game may be a house-banked poker game and the side game may be a house-banked poker game.

In accordance with yet another feature of the present invention, the side game may utilize a different monetary value casino chip than the chips utilized in the base poker game. The side game may also include utilizing an electronic form of payment to participate in the side game.

In accordance with the present invention, an electronic device for displaying a side game associated with a base game to a player is disclosed. The device may include a display device, a user input device configured to generate a signal indicative of a player's selection input, a wager input device configured to receive information relating to a monetary value enabled for wagering in the game, and at least one gaming controller in communication with a source of randomly generated game data for providing random game outcomes used in a base game, the display device and the user input device. The at least one gaming controller may be operable to detect wagering input via the wager input device, the wagering input relating to one or both of a wager in the base game and wager in the side game. Additionally, the game controller is in communication with the source of randomly generated game data causing the display of standard playing cards of varying rank to form hands and a group of community playing cards in the base game on the display device. The game controller determines the outcome of the side game, wherein the outcome of the side game is determined by comparing the first three community playing cards with one or more preset combinations of playing cards. An award of a payout may be given to the players from which a side bet is received responsive to the payout triggering event being triggered by the comparison. Also, the device may maintain the side bets received in a pot to be made available for the next side game responsive to the group of community playing cards receiving less than a preset number of playing cards in the base game. Additionally, the device may assign a portion of the side bets received to a progressive jackpot and/or collecting the remainder as a loss responsive to the payout triggering event not being triggered.

In accordance with yet another feature of the present invention, the preset number is three.

In accordance with an additional feature of the present invention, the electronic device may be shared by a plurality of users and/or poker tables.

In accordance with another feature of the present invention, the electronic device may display a progressive jackpot amount.

In accordance with the present invention, a method for displaying a side game associated with a base game to a player is disclosed that includes the method being facilitated by a game controller including processing devices, servers and data storage devices, configured to communicate with a remote user device, such as a mobile phone, personal computer or tablet, over a global communication network, such as the Internet. The method comprises the steps of game controller being configured to receive and detect signals indicative of players' selections input entered into through the remote user device, detecting a wager being input by the player, wherein the wager may be for real money or virtual currency. Additionally, the game controller is in communication with a source of randomly generated game data for providing random game outcomes used in a base game, causing the display of standard playing cards of varying rank to form hands and a group of community playing cards in the base game on the remote user device. The game controller determines the outcome of the side game, wherein the outcome of the side game is determined by comparing the first three community playing cards with one or more preset combinations of playing cards. The game controller awards a payout to the players from which a side bet is received responsive to the payout triggering event being triggered by the comparison, wherein the payout may be added to the players' respective virtual currency. The game controller maintains the side bets received in a pot to be made available for the next side game responsive to the group of community playing cards receiving less than a preset number of playing cards in the base game. The game controller assigning a portion of the side bets received to a progressive jackpot and/or collecting the remainder as a loss responsive to the payout triggering event not being triggered.

Although the invention is illustrated and described herein as embodied in a method, system, and device for conducting a side bet for a poker game, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

DETAILED DESCRIPTION

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The invention provides a method and device used to conduct a side bet for a poker game that overcomes the disadvantages of the heretofore-known devices and methods of this general type and that provides a method and device that involved in a base game, wherein, upon the happening of an event triggered through the dealing of community playing cards, e.g., a "pair" dealt on the "flop" of a Texas Hold'em Poker game (i.e., the "base game"), a player is awarded a payout based on the amount of the side bet, a card value, and/or payout scale associated with.

Although the invention is illustrated and described herein as embodied in a method of and device used to conduct a side bet for a poker game, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, using, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

In one embodiment of the present invention a poker table with various player seats are used to carry out the described invention. The described invention provides an exciting side game method used in connection with a base poker card game wherein the optional side bet initiates a side game utilizing the first three community cards dealt and enables the player to obtain a significant payout based on a random outcome of the first three community cards dealt in the base poker game. The term "side game" is defined as any additional action or series of actions taken in connection with an action or series of actions associated with a base game.

To begin, the described invention includes at least two players at the poker table placing a primary wager, e.g., ante, small blind, big blind or other wager that may or may not be required to participate in the base game. In addition to the base game wager, players also may place the optional side bet associated with the base poker game. The term "side bet" generally refers to an optional wager placed in connection with, but collateral to, a base game wager. The side bet is a proposition wager being determined based on the outcome of a future event which is typically independent of the outcome in the base game. Preferably, a gaming table or computerized simulation thereof will have various portions demarcated for the placement of the side bet, either physically or electronically, such as via a player interface. In some instances, depending on the number of players at the table and house rules, at least one player may participate in the base game without placing a primary wager in the base game and may still place the side bet, qualifying that player to participate in the base game and side bet associated with the base game. In some embodiments, players may place a side bet and thus be qualified to participate in the side bet game without participating in the base game.

In the event, the base game is completed and/or resolved prior to the happening of the dealing of "the flop" or the first three community playing cards, the player(s) side bets would in some embodiments, push, that is, remain in a pot to be made available in the next round. For example, if a player at the table raises pre-flop and all other players fold, the "flop" would not be dealt, and would not allow the triggering event to occur. In some embodiments, the side bets remain, and additional side bets are required to participate, thus progressively increasing the potential payout, responsive to the flop failing to occur in the base game. In some embodiments, only a portion of the side bets remain available.

In some embodiments, all players placing the side bet will be eligible to win the same odds, while in other embodiments, all players placing the side bet will be eligible to win a share of the payout amount based on the number of players. Should the necessary community group of cards be formed, that is, should the flop occur, but the flop fails to include a winning rank or card combination in the side game, then the side bets may be lost. In some embodiments, a portion of the lost side bets may be used to fund a progressive jackpot.

The below exemplary pay table shows a version of the game method of the invention wherein the triggering event and the player payout would be solely dictated by the "community cards." In this version the unique value of "the flop" or the first three community cards would trigger a payout from the pay table and/or a progressive jackpot. For example, if the first three community cards form a three-of-a-kind, that three-of-a-kind will then be compared to the payout scale to determine the odds and the player payout. In the below exemplary pay table the odds for three of a kind pay 21 for 1 or 20 to 1. Therefore, a $5.00 side bet would pay the player $100.00 and a $10.00 side bet would pay the player $200.00.

TABLE 1

| Flop | Pays |
|---|---|
| Pair | 1 to 1 |
| Straight | 5 to 1 |
| Flush | 5 to 1 |
| Three of a kind | 20 to 1 |
| Straight flush | 20 to 1 |
| Mini Royal | 100 to 1 |
| Mini Royal in hearts | 500 to 1 |

The below exemplary mathematical analysis of the described invention corresponds with the pay table described above. For example, the below mathematical evaluation concludes that there are exactly 22,100 possible 3 card combinations created by a 52-card deck of playing cards. The analysis includes hand rankings, combinations, probability, odds for 1, and expected value. For example, the side game will produce a theoretical House Edge of 4.05%. In other words, $4.05 of every $100.00 bet on the side game will be considered revenue for the Casino. This is the major advantage of the described invention. The Casino will now have a secondary source of revenue, in addition to the "rake" of the player-banked base game.

TABLE 2

| Hand | Comb | Probability | Odds (for 1) | Expected Value |
|---|---|---|---|---|
| Pair | 3744 | 0.169411765 | $ 2.00 | 33.88% |
| Flush | 1096 | 0.04959276 | $ 6.00 | 29.76% |
| Straight | 720 | 0.032579186 | $ 6.00 | 19.55% |
| Three of a kind | 52 | 0.002352941 | $ 21.00 | 4.94% |
| Straight flush | 44 | 0.00199095 | $ 21.00 | 4.18% |
| Mini Royal | 3 | 0.000135747 | $101.00 | 1.37% |
| Mini Royal in hearts | 1 | 4.52489E−05 | $501.00 | 2.27% |
| Total | 22100 | | | |
| | | | RTP | 95.95% |
| | | | House Edge | 4.05% |

In further embodiments of the invention, the payout amount is based on the amount of the current progressive jackpot. In this manner, if any or all players do not win, i.e., the triggering event is not met, a portion of the side bet money is allocated to the next round, where one or more players will be eligible to win in total or in part of the combined accumulated side bets. In some embodiments, the "dealer" and the "house" will proportionately share the benefit of players' losing wagers. In addition, the dealer or dealers may receive a portion of the payout resulting from a winning combination of cards. This feature will advantageously keep dealers motivated to promote the game.

In the above-described base game of poker, some level of skill is combined with a side game where a player payout is based solely on chance, a combination many users and administrators of the described invention will find desirable. The method and device described combines a card game requiring at least one player decision, and the side game based solely on chance and not requiring the player to decide.

The described invention may combine a player-banked and a house-banked poker game, to satisfy the requirements of the gaming jurisdiction of which the game is being played. Further, the base game and side game may be banked the same or differently. In the preferred embodiment, the base game is player-banked, and the side game is house-banked. For example, the base game of Texas Hold'em Poker is "player-banked" and the side game is "house-banked." In addition, this side game that is triggered by a unique value of the plurality of playing cards in the base game of the many variations of poker, including but not limited to Texas Hold'em, Stud, and Omaha.

The described invention may use the same or different poker chips for the base game and the side game, since in the preferred embodiment the base game is player-banked, and the side game is house-banked. Some casinos and or gaming jurisdictions may require a different form of monetary value for use in the side game. For example, other embodiments of the described invention may include different chips or electronic payment methods like that of use with electronic table games or slot machines.

The base game and side game can be played as live table game in a gaming establishment, e.g., a casino, a virtual table game in a gaming establishment or online over a network (e.g., using the Internet), or an electronic/slot machine game in a gaming establishment. Moreover, the present invention can also be carried out online over network or offline using a desktop computer, mobile device, tablet, a smartphone, or any other electronic processing device with or without wireless or LAN capabilities.

The steps of the present invention, which are explained in more detail above, can be embodied in a computer program that is executable by one of the above-described processors, that may be on (e.g., communicatively coupled to) a video gaming machine. Computer programs (also called computer control logic) are stored in memory such as main memory, removable storage drive, removable media, hard disk, and signals. Such computer programs, when executed, enable the computer system to perform the features of the present invention as discussed herein. The computer programs, when executed, enable the processor to perform the steps of the present invention. In this document, the terms "computer program medium," "computer usable medium," and "computer readable medium" are used to generally refer to media such as main memory, removable storage drive, removable media, hard disk, and/or signals. These computer program products are means for providing software to the computer system. The computer readable medium allows the computer system to read data, instructions, messages or message packets, and other computer readable information from the computer readable medium. The computer readable medium, for example, may include non-volatile memory, such as Floppy, ROM, Flash memory, Disk drive memory, CDROM, and other permanent storage. It is useful, for example, for transporting information, such as data and computer instructions, between computer systems. Furthermore, the computer readable medium may include computer readable information in a transitory state medium such as a network link and/or a network interface, including a wired or wireless network, which allows a computer to read such computer readable information.

As such, the video gaming machine implemented with carrying out the above-described steps may include a computing means, e.g., a processor, and a storing means, e.g., a memory. The processor is operable to run one or more programs/applications and interfaces associated with the video gaming machine or stored on the memory to effectuate the data transfer and communications required by the present invention. The video gaming machine may also have other components or features that may include an image capturing element, lights, multiple displays, or other transducers.

In one software embodiment, the program may be designed to API interface or be added onto an existing online poker game that does not have a side bet. This advantageous embodiment will allow for easier installation across multiple different platforms such as different online casinos that offer real money poker games and free to play or social poker games.

What is claimed is:

1. An electronic device for displaying a side game associated with a base game to a player, comprising: a display device; a user input device configured to generate a signal indicative of a player's selection input; a wager input device configured to receive information relating to a monetary value enabled for wagering in the game; and at least one gaming controller in communication with a source of randomly generated game data for providing random game outcomes used in a base game, the display device and the user input device, said at least one gaming controller being operative to:

detect wagering input via the wager input device, the wagering input relating to one or both of a wager in the base game and wager in the side game;

the game controller in communication with the source of randomly generated game data causing the display of standard playing cards of varying rank to form hands and a group of community playing cards in the base game on the display device;

the game controller determining the outcome of the side game, wherein the outcome of the side game is determined by comparing the first three community playing cards with one or more preset combinations of playing cards;

awarding a payout to the players from which a side bet is received responsive to the payout triggering event being triggered by the comparison;

maintaining the side bets received in a pot to be made available for the next side game responsive to the group of community playing cards receiving less than a preset number of playing cards in the base game; and assigning a portion of the side bets received to a progressive jackpot and/or collecting the remainder as a loss responsive to the payout triggering event not being triggered.

2. The device according to claim 1, wherein the preset number is three.

3. The device according to claim 1, wherein the electronic device may be shared by a plurality of users and/or poker tables.

4. The device according to claim 1, wherein the electronic device may display a progressive jackpot amount.

5. A method for displaying a side game associated with a base game to a player, the method being facilitated by a game controller including processing devices, servers and data storage devices, configured to communicate with a remote user device, such as a mobile phone, personal computer or tablet, over a global communication network, such as the Internet, the method comprising the steps of:

the game controller being configured to receive and detect signals indicative of players' selections input entered into through the remote user device, detecting a wager being input by the player, wherein the wager may be for real money or virtual currency;

the game controller, in communication with a source of randomly generated game data for providing random game outcomes used in a base game, causing the display of standard playing cards of varying rank to form hands and a group of community playing cards in the base game on the remote user device;

the game controller determining the outcome of the side game, wherein the outcome of the side game is determined by comparing the first three community playing cards with one or more preset combinations of playing cards;

the game controller awarding a payout to the players from which a side bet is received responsive to the payout triggering event being triggered by the comparison, wherein the payout may be added to the players' respective virtual currency;

the game controller maintaining the side bets received in a pot to be made available for the next side game responsive to the group of community playing cards receiving less than a preset number of playing cards in the base game; and the game controller assigning a portion of the side bets received to a progressive jackpot and/or collecting the remainder as a loss responsive to the payout triggering event not being triggered.

6. The method according to claim 5, wherein the preset number is three.

* * * * *